United States Patent [19]

Lapeyre

[11] 3,976,022

[45] Aug. 24, 1976

[54] FLOATING DRY DOCK WITH BUOYANCY CONTROLLED AIR INJECTION AND VENTING SYSTEM

[76] Inventor: Pierre A. Lapeyre, P.O. Box 430, Houma, La. 70360

[22] Filed: Feb. 3, 1975

[21] Appl. No.: 546,790

[52] U.S. Cl. ..... 114/45

[51] Int. Cl.[2] ..... B63C 1/02

[58] Field of Search ..... 114/45, 44, 48; 61/65

[56] References Cited

UNITED STATES PATENTS

| | | | |
|---|---|---|---|
| 3,276,211 | 10/1966 | Drake | 114/45 X |
| 3,332,248 | 7/1967 | Burnett | 114/44 X |
| R27,090 | 3/1971 | Rutter | 61/65 |

*Primary Examiner*—Trygve M. Blix
*Assistant Examiner*—Gregory W. O'Connor
*Attorney, Agent, or Firm*—Wilkinson, Mawhinney & Theibault

[57] ABSTRACT

The present disclosure is directed to lifting boats and barges within a dry dock by means of compressed air. The air is conducted from compressor through hose lines to open bottomed compartments of the floating dry dock and controlled by remote actuated valves whereby either through adding air or venting air from the dock compartments the dock may be trimmed fore and aft as well as athwart ship to assure registry with a yard marine railway system. Support legs guide the up and down movement of the dock to assure alignment with the marine railway so that the vessel within the dock may be transferred by a dolly and rail system to the yard rail system. The floating dry dock upon achieving proper elevation releases a certain amount of air such that some negative buoyancy is attained and the dry dock and its within vessel are supported on the support legs which will prevent movement of the dry dock while transferring the vessel to shore and which will also prevent movement of the dry dock by wave action from passing vessels.

1 Claim, 6 Drawing Figures

FLOATING DRY DOCK WITH BUOYANCY CONTROLLED AIR INJECTION AND VENTING SYSTEM

An object of the present invention is to provide a vertically guided hydro-pneumatic elevator for raising ships and barges to alignment with a marine yard rail system so that the vessel may be moved to a work area in the yard and upon completion of work placed back in the water. The elevator is in the form of a dock having open bottomed buoyancy compartments which may be selectively pressurized or vented to trim the dock fore and aft as well as athwart ship to assure proper registry of the dolly upon which the vessel rests out of the water with the rail system of a marine work yard. A leg support system performs a dual function of not only assuring vertical alignment of the dock with the rail system of the yard but to also support the dock to avoid movement fore and aft during transfer of the vessel from the dock to the yard and to protect against wave movement from passing vessels disturbing the dock during the critical transfer period.

Another object of the present invention is the provision of a dock having hydro-pneumatic characteristics without any rotating machinery such as compressors or pumps aboard the floating dry dock.

A still further object of the present invention is the elimination of slings, hoists, cables and winches for taking a vessel from the water and placing it on land and vice versa.

With the foregoing and other objects in view the invention will be more fully described hereinafter and more particularly pointed out in the appended claims.

In the drawings, in which like parts are denoted by reference characters throughout the several views.

Figure 1:
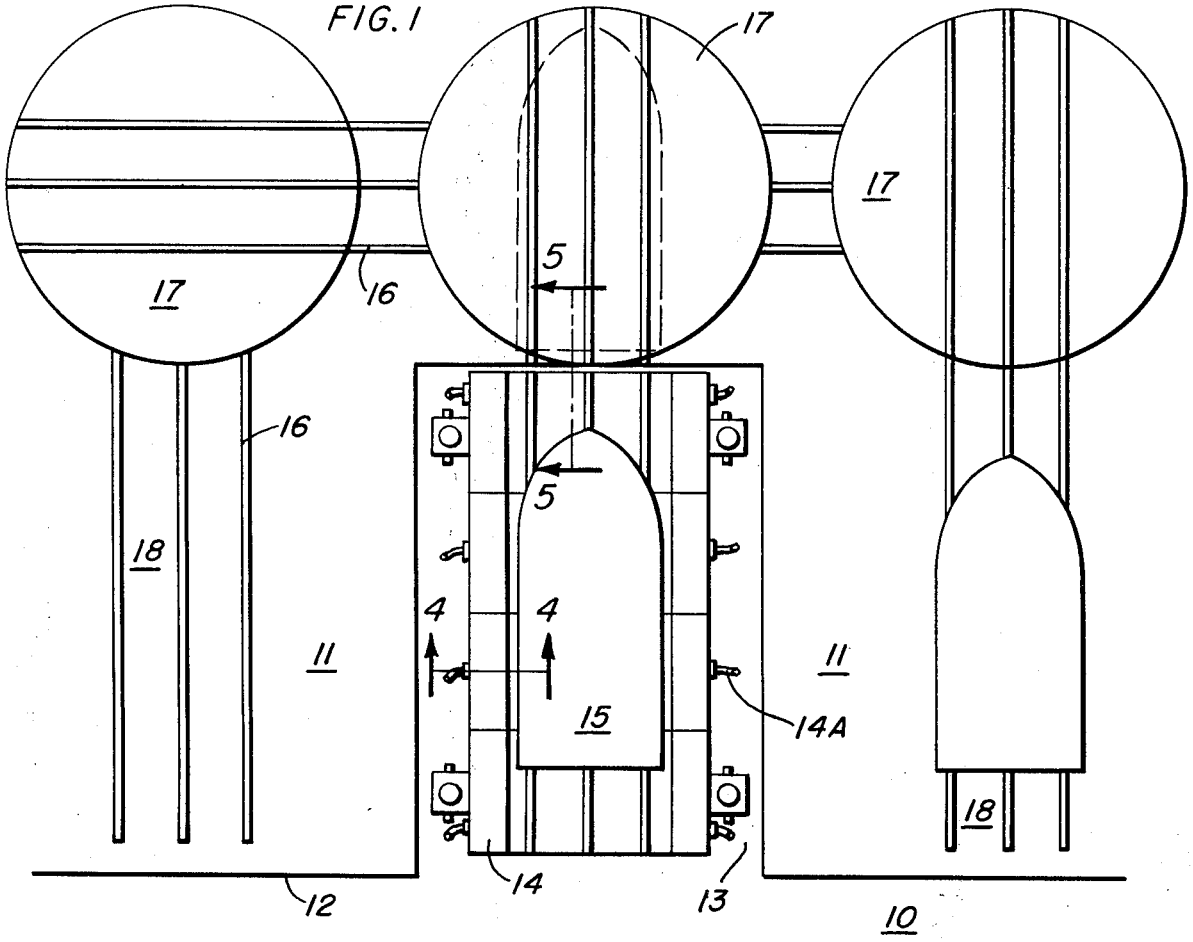
FIG. 1 is a top plan view of a marine repair yard having a docking slip within which the floating dry dock is raised and lowered and a marine railway system for moving vessels from the dock to a work area.
Figure 5:
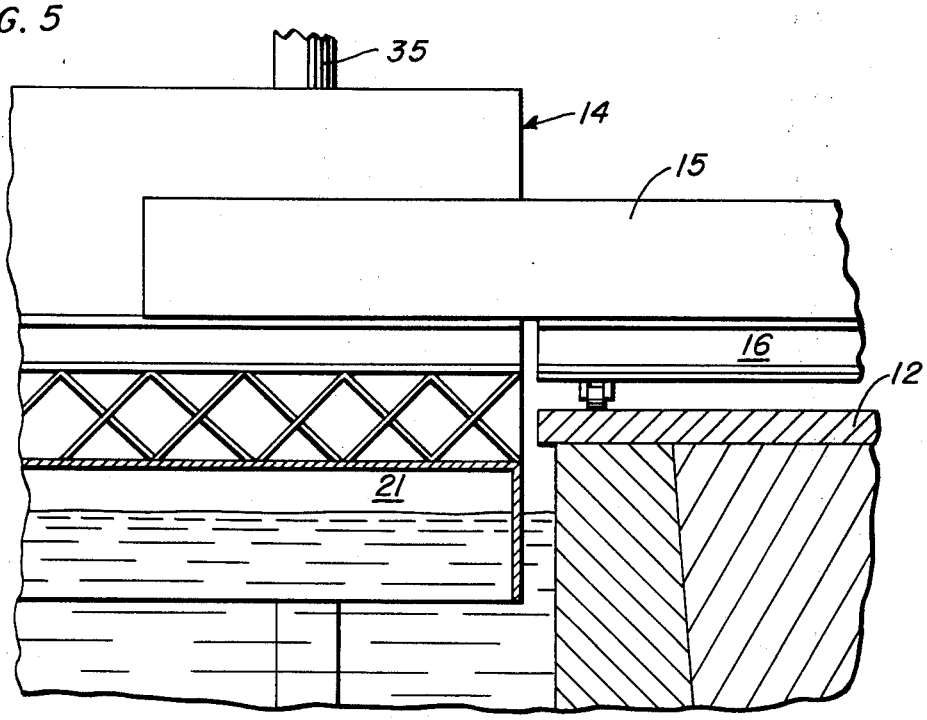
FIG. 5 is a fragmentary longitudinal section showing the dock in a vessel transfer condition for moving a barge from the dock to the marine yard, taken on the line 5—5 in FIG. 1.

Referring now to the drawings and for the moment to FIG. 1, the environment in which the floating dry dock of the present invention would best be understood, 10 designates a river or bayou having a marine repair yard 11 on its bank 12. A vessel transfer slip 13 provides a shelter area in which the floating dry dock 14 of the present invention operates to transfer vessels 15 from the water onto dollys so that the vessel may be moved along the marine rail system 16 with the aid of turn table 17 to work areas 18 where underside hull repairs may be effected.

Figure 2:
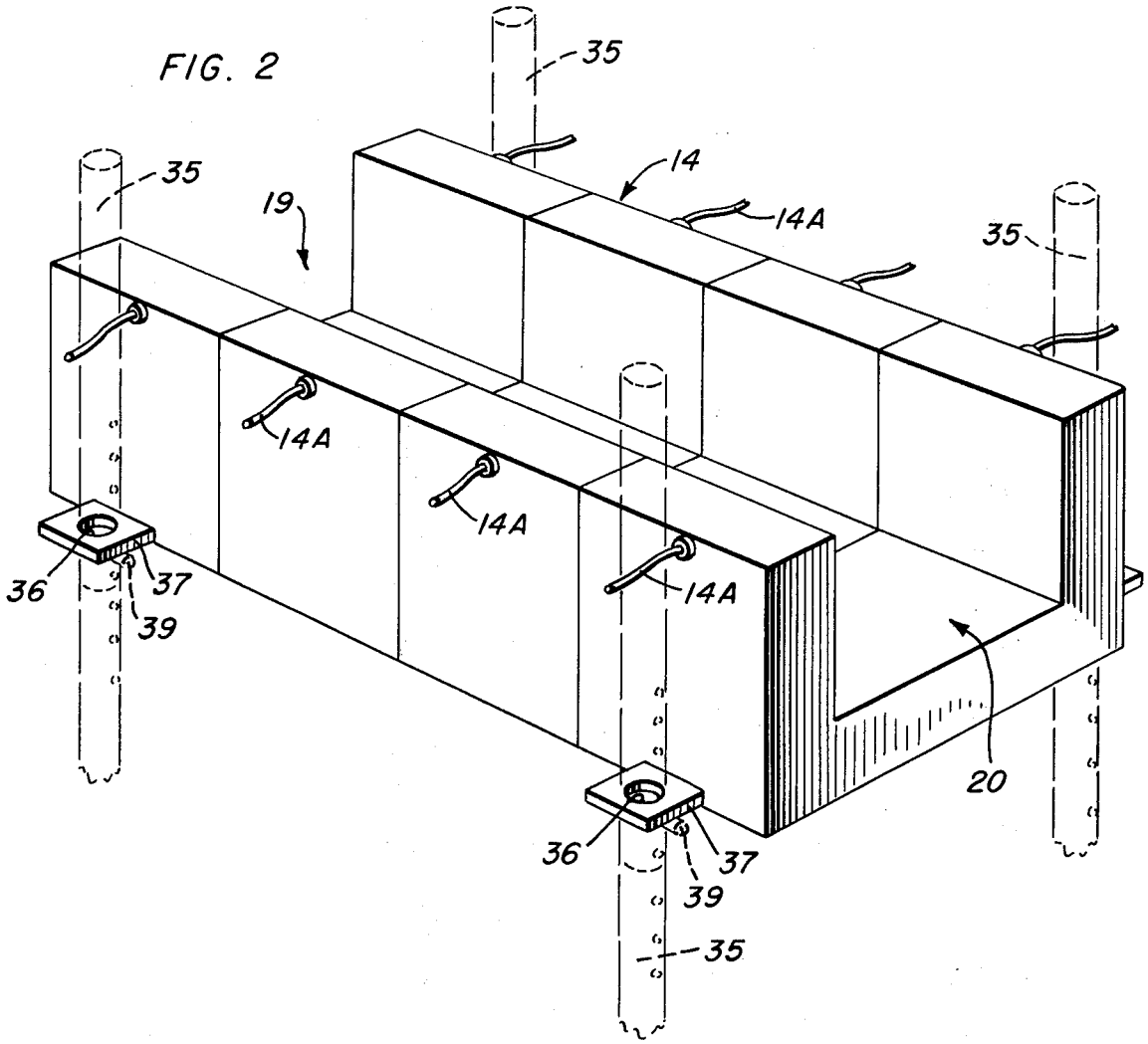
FIG. 2 is a perspective view of the floating dry dock and its guide-support legs.
Figure 4:
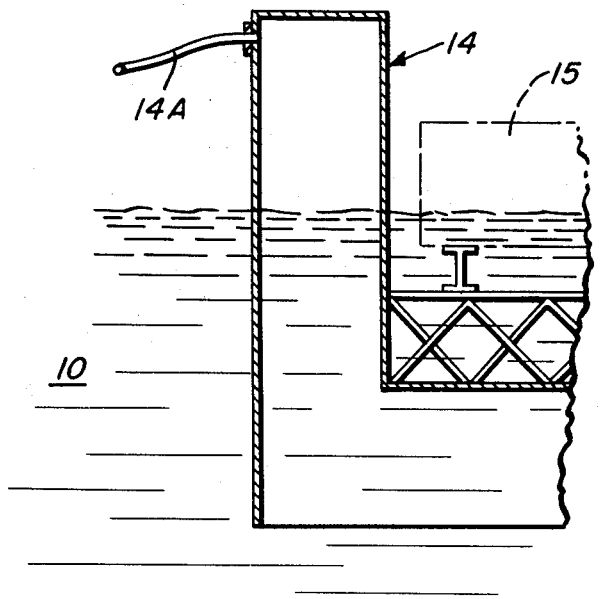
FIG. 4 is a fragmentary transverse sectional view of the dry dock in an elevating condition with a barge inside, taken on the lines 4—4 in FIG. 1.
Figure 6:
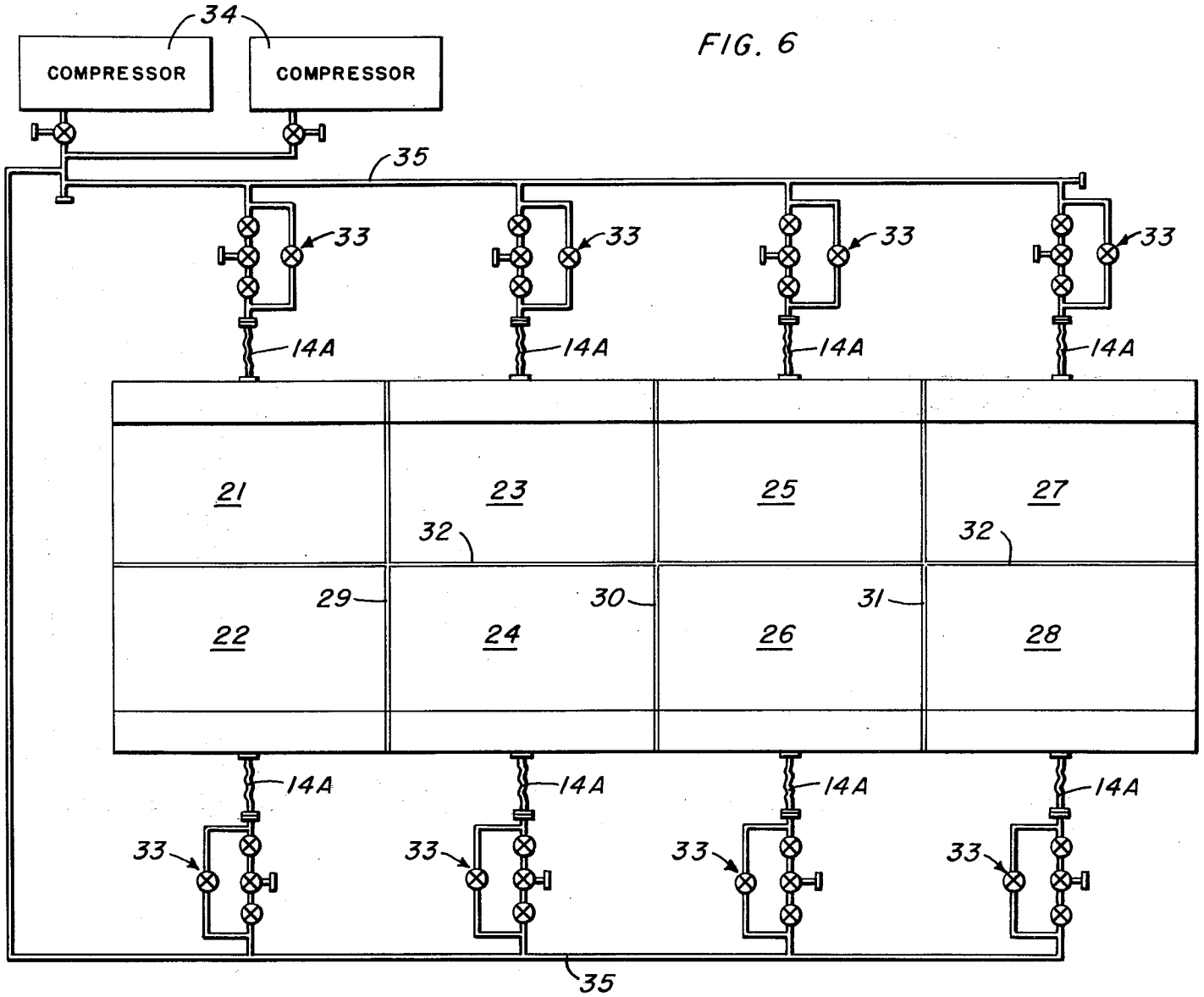
FIG. 6 is a schematic view of the dry dock and its compressor pneumatic-venting system for raising and trimming the floating dry dock.

As seen in FIG. 2 the floating dry dock 14 has open ends 19, 20 to permit passage of a vessel 15 therethrough. In cross section the dock 14 is generally of U-shape and is divided into a plurality of open bottomed compartments 21,22,23,24,25,26,27,28 (see FIG. 6). Partitions 29,30 and 31 define compartments which provide fore and aft trim while central partition 32 defines the athwart ship trim or list control.

Each of the compartments 21 through 28 have flexible hose connections 14A through a valve manifold 33 (FIG. 6) so that each compartment may be selectively either vented to flood same to cause the dock to submerge for taking on or discharging a vessel 15 or to raise the dock by supplying low pressure air from compressors 34 through lines 35 to blow water out of each compartment through its open bottom somewhat similar to the diving and surfacing of a submarine. The control valve manifolds 33 may be mounted on a console in an array to permit one operator to control the raising and lowering of the dock as well as its trimming from landside 11 and not on the dock 14. The compressors 34 are likewise placed landside to avoid placement of rotating machinery on the floating dock 14 which would require the dock to be larger than is necessary to perform its hydro-pneumatic elevator operation.

Figure 3:
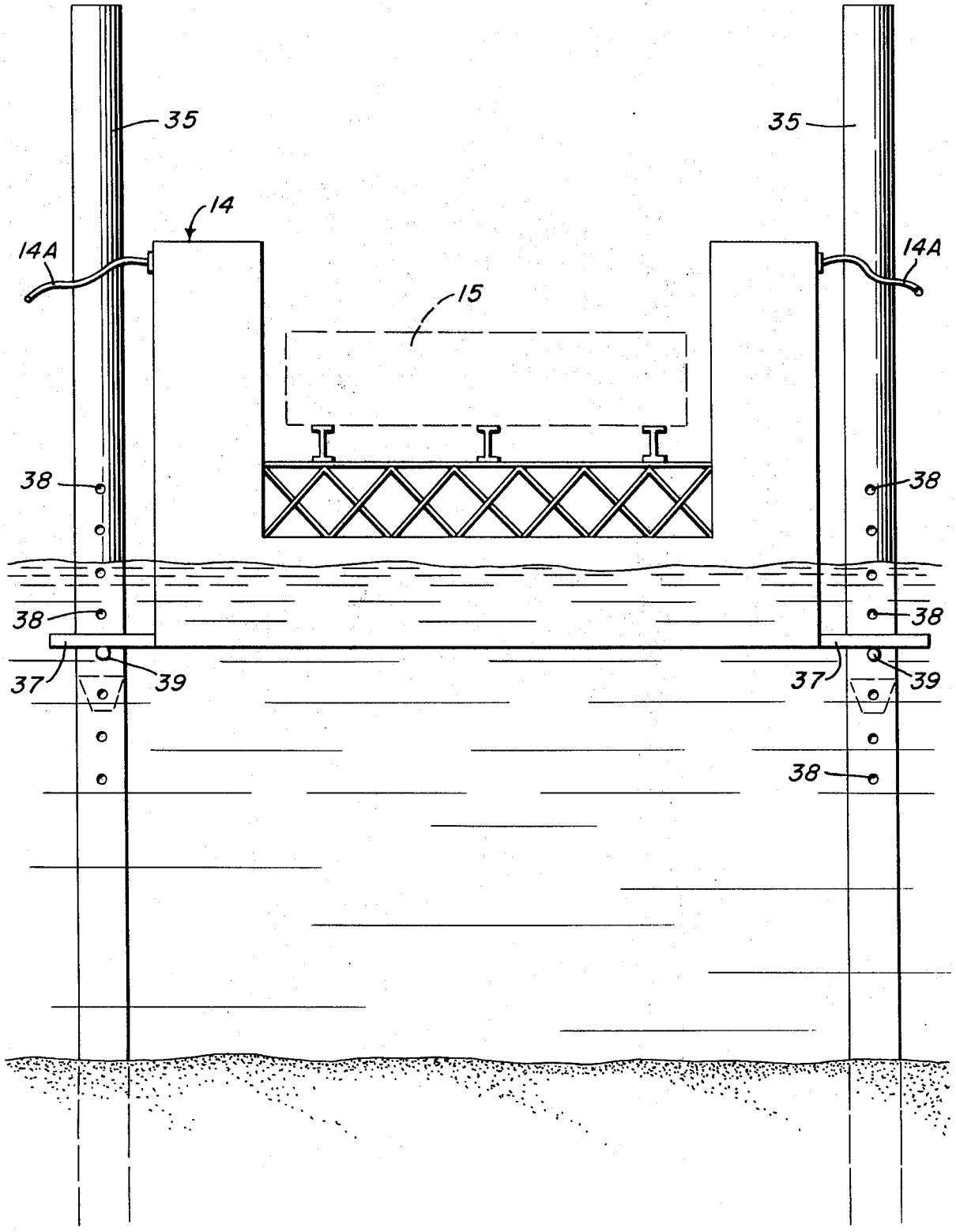
FIG. 3 is a rear elevational view of the floating dry dock of FIGS. 1 and 2 resting in its locked vessel transfer attitude on the guide-support legs.

The up and down movement of the dock 14 is guided by stabbing or pilings 35 which pass through openings 36 in plates 37 which are welded to the dock 14 as best seen in FIG. 3. The pilings 35 have openings 38 therethrough to receive locking pins 39 which are passed therethrough when the dock 14 and its vessel 15 is in proper registry with the yard transfer rails 16. With the pins 39 in place the vessel 15 may be pulled from the dock 14 onto the yard rail system by a bulldozer, tractor or the like without tipping the dock along its fore and aft axis. The air compressors 34 may be shut down until it is again time to put a vessel back into the water at which time the vessel is pushed onto the dock in place and all compartments are pressurized to cause the dock 14 to rise so that the plates 37 do not bear against the locking pins 39 and they may be removed from the pilings 35 whereby upon venting the valves 33 air will escape from each of the buoyant compartments and the dock 14 will sink so that the within contained vessel 15 becomes buoyant and may be removed from the dry dock 14 into the river stream or bayou 10 under its own power.

What I claim is:

1. A floating dry dock with buoyancy control for use with a landside marine yard railway comprising an open bottom U-shaped multi-compartment dock longer and wider than the vessel to be transferred to the marine yard railway, low pressure air lines connected to the top of the leg of the U-shape of each open bottomed compartment, compressor means connected to supply air to said low pressure air lines, control means in each air line to regulate air flow to and from each compartment to trim the dock for alignment with the marine yard railway for transfer of a boat in said dock to the marine railway, a plurality of vertical guide means having openings along their length along which said dry dock moves between a flooded down condition and a buoyant vessel transfer condition, guide plates carried by the bottom of said dock having openings therethrough through which said vertical guide means pass, and locking pins receivable through the openings along said vertical guide means positioned to be engaged by said plates to support the dock and vessel during transfer of a vessel from the dock to the marine railway to permit shutdown of the compressor without disturbing the trim of the dry dock.

* * * * *